United States Patent [19]

Sweeney, Jr.

[11] 4,358,105

[45] Nov. 9, 1982

[54] PROGRAMMED EXERCISER APPARATUS AND METHOD

[75] Inventor: James S. Sweeney, Jr., Laguna Beach, Calif.

[73] Assignee: Lifecycle, Inc., Irvine, Calif.

[21] Appl. No.: 180,109

[22] Filed: Aug. 21, 1980

[51] Int. Cl.[3] ..... A63B 21/24; A63B 23/04

[52] U.S. Cl. ..... 272/73; 272/129; 272/DIG. 5; 73/379

[58] Field of Search ..... 272/73, 93, 129, DIG. 5, 272/DIG. 6, 130; 73/379; 128/363, 364; 364/410, 413

[56] References Cited

U.S. PATENT DOCUMENTS

| | | | |
|---|---|---|---|
| 3,057,201 | 10/1962 | Jaeger | 73/379 |
| 3,395,698 | 8/1968 | Morehouse | 272/DIG. 6 |
| 3,501,142 | 3/1970 | Johansson | 272/73 |
| 3,505,992 | 4/1970 | Jaeger | 128/2 |
| 3,589,193 | 6/1971 | Thornton | 73/379 R |
| 3,765,245 | 10/1973 | Hampl | 73/379 |
| 3,767,195 | 10/1973 | Dimick | 272/73 |
| 3,845,756 | 11/1974 | Olsson | 128/2.06 R |
| 3,984,666 | 10/1976 | Barron | 235/151.3 |
| 4,060,239 | 11/1977 | Pfleiderer et al. | 272/73 |
| 4,112,928 | 9/1978 | Putsch | 128/2.05 R |
| 4,184,678 | 1/1980 | Flavell et al. | 272/DIG. 6 |
| 4,244,021 | 1/1981 | Chiles | 272/73 |

*Primary Examiner*—Vance Y. Hum

*Attorney, Agent, or Firm*—Thomas J. Plante

[57] ABSTRACT

An exerciser is disclosed, of the type providing automatically controlled variations of effort levels, wherein "random" variations of effort level are included which are not predictable by the operator. The effort levels [steps] are provided in a sequence of four: the second [step] level is random; the fourth [step] level is different from the second [step value] level by half of the range; and the first and third [steps] levels are averages of the immediately preceding and immediately following [steps] levels.

20 Claims, 6 Drawing Figures

PROGRAMMED EXERCISER APPARATUS AND METHOD

BACKGROUND OF THE INVENTION

This invention relates to exercise apparatus, and particularly to an exerciser, such as a bicycle exerciser, which is programmed to provide automatically-varying levels of exercise effort, for the dual purposes of enhancing fitness due to exertion variations and of providing increased interest for the user by avoiding a monotonous exercise program.

As explained in Dimick U.S. Pat. No. 3,767,195, issued On Oct. 23, 1973, and assigned to the assignee of this application, both physiological and psychological benefits are provided by a programmed exerciser which automatically varies the level of effort demanded from the operator. The patent points out that a "training efect" is derived from using such an apparatus. The patent proposes the use of an automatically variable resistance to operator force, which simulates the effect of hills of varying steepness. It discloses (see FIG. 6) and claims a series of different successive torque loads of sequentially increasing magnitude.

The Dimick apparatus avoids the limitations of other prior art exercisers which rely on the operator to vary the load, or rate of energy output demanded. However, by providing a program known to the operator in advance, it risks losing the interest of the operator, at least to some degree.

The primary thrust of the present invention is the development of an automatically programmed, variable effort level exerciser which goes much further than previous exercisers, including the Dimick apparatus, in creating sustained interest for the operator, and minimizing the boredom which would otherwise be encountered in regularly using the exercising apparatus. The problem of loss of motivation, due to boredome, is probably the foremost inhibitor of sustained physical fitness training.

SUMMARY OF THE INVENTION

The present invention provides an automatically programmed exerciser having at least a portion of the effort level determined randomly, using data in the computer. The random portion of the effort level is not predictable by the operator, and therefore enhances interest in the exercise program. Preferably a substantial portion of the exercise program is automatically related to the random portion in such a way that the total effort of the operator remains within a preselected range of difficulty.

In other words, the present invention provides an exercise program which varies the rate of energy expenditure by the operator in a manner which conforms to certain criteria, but which cannot be known to the operator in advance. This random program is divided into a series of short segments of time which periodically includes a segment having a randomly-selected level of energy expenditure, separated from preceding and following randomly-selected levels by segments demanding levels of energy expenditure which are automatically calculated from adjacent randomly-selected levels.

Because the objects of the present invention are obtainable whenever the operator of the exerciser is substantially precluded from predicting the sequence of variations in the effort level, the use of programming to create a pseudo-random sequence is considered to be within the scope of the present invention.

DETAILED DESCRIPTION OF PREFERRED EMBODIMENT

Figure 1:
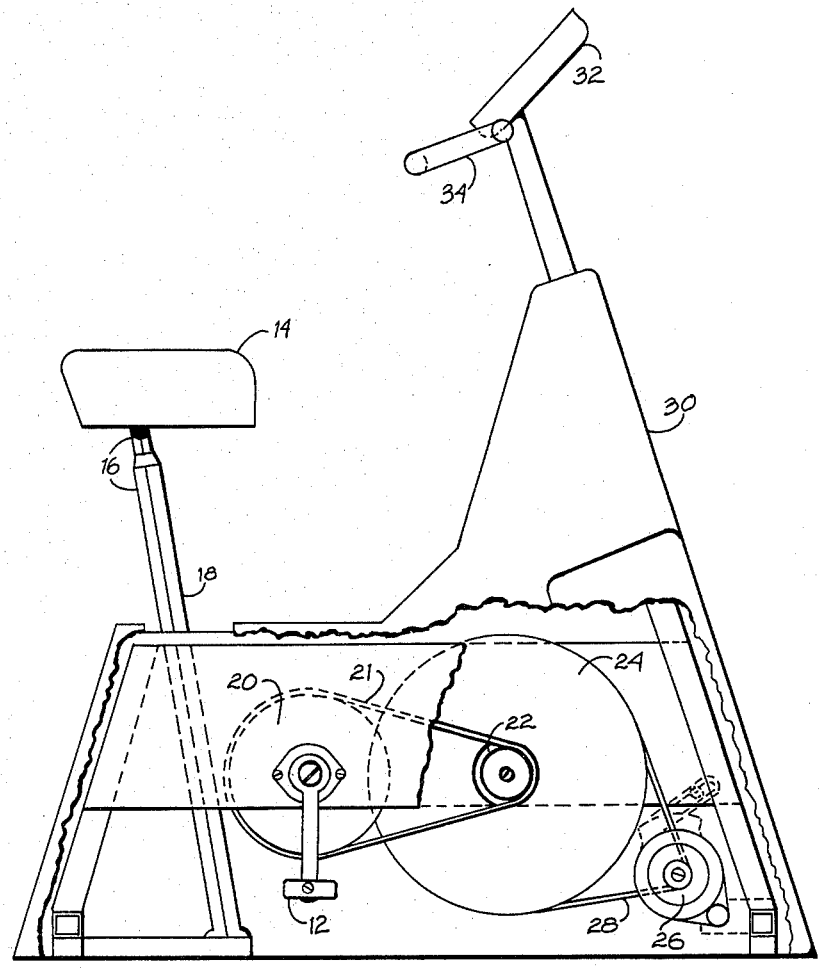
FIG. 1 is a side elevation of a cycle-type exerciser, partly broken away to show the mechanisms for varying the load encountered by the operator.

As shown in FIG. 1, the exerciser, or ergometer, apparatus used in the preferred embodiment is a "cycle" type exerciser having the usual pedals 12 pushed by the feet of the operator sitting on a seat 14, which is vertically adjustable by telescopic movement of the seat-supporting column 16 within the tubular holder 18. Movement of pedals 12 rotates a sprocket 20, which causes a chain 21 to drive a small diameter sprocket 22 attached to a flywheel 24.

The variable load which the operator must overcome in order to rotate sprocket 20 is generated by an alternator 26, which provides a variable resistance to the operator's effort through its driving connection with flywheel 24 by a gear belt 28. The driving and loading mechanism is enclosed within a housing 30, which supports at its upper end a display panel 32, and provides a suitable handlebar 34.

It should be understood that the principles of the present invention are applicable to any variable effort ergometer, and are not limited to use with a cycle exerciser, although that appears to be the most convenient and effective means of providing a fitness training program.

Figure 2:
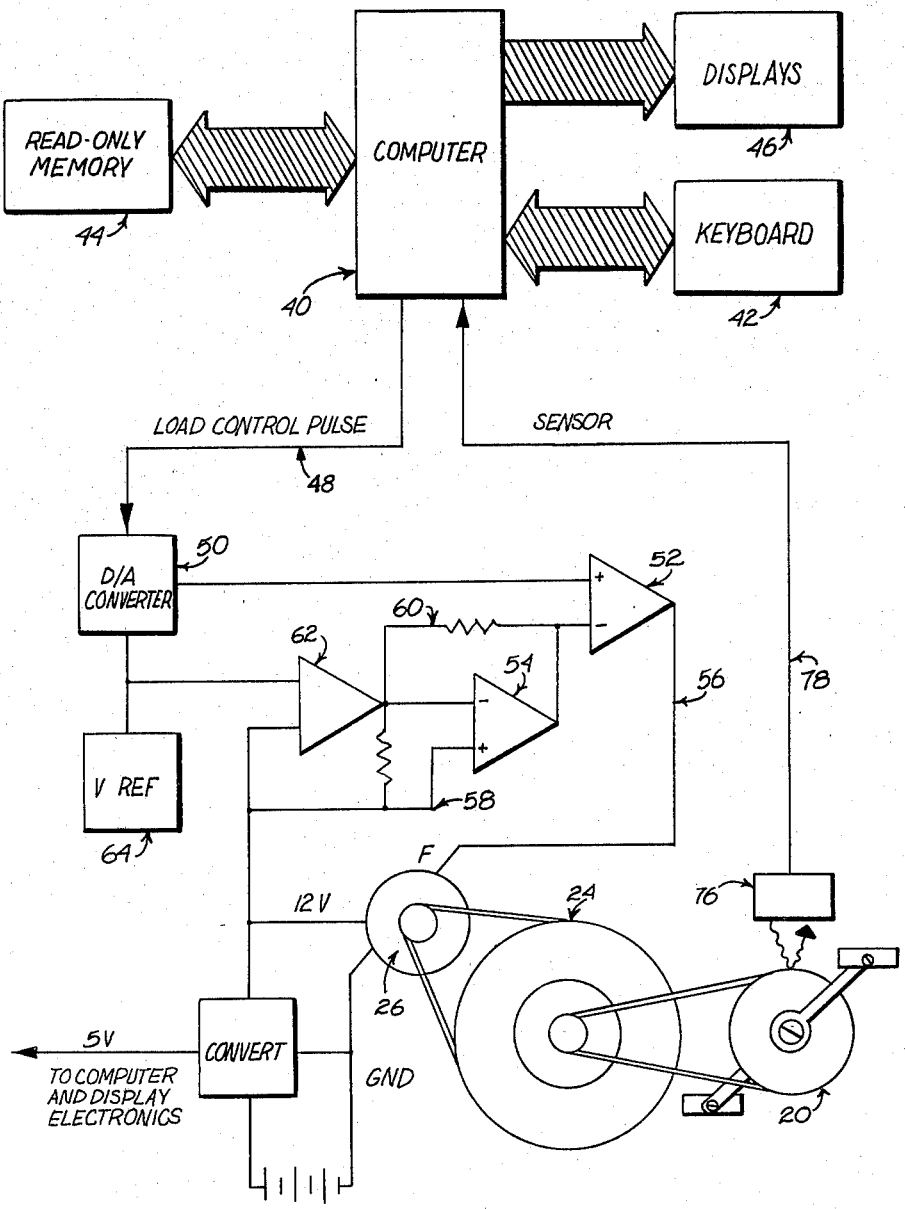
FIG. 2 is a schematic showing the electronic control system used to vary the load on the cycle exerciser of FIG. 1.

The electronic control system which determines the program-generated loading of the alternator 26 is shown in FIG. 2. A microcomputer 40 communicates electronically with a keyboard 42, a read-only memory 44, and display electronics 46 associated with the display panel 32. The keyboard 42 is used to input manually the exercise program selection, and also data for computation of a measure of fitness, such as MOU (maximal oxygen update). The read-only memory 44 has the operating program for the microcomputer, and a plurality of stored exercise programs available to the "cycle" operator.

Microcomputer 40 operates the displays, scans the keyboard, and outputs a signal, via line 48, which controls the loading circuit of the alternator 26. The output of the microcomputer on line 48 is a pulse width modulated signal, the width of which is proportional to the work demanded of the cycle operator. The effect of changes in this pulse width signal is to vary the field current in the alternator, thereby causing variations in the resistance of the alternator to the force exerted by the operator. The alternator, because of its feedback loop circuitry, also has the highly desirable feature that the effort required is independent of the exercise rate, i.e., if the operator pedals the exerciser more slowly, the loading increases to maintain a substantially constant work level, which is important in aerobic and cardiac exercise. This maintenance of effort regardless of velocity occurs because the power output of the alternator (voltage×current) is directly related to the operator's input effort (taking into account the mechanical efficiency factor). The circuit is regulated to output constant power, thereby demanding constant input energy, except as the programming changes the energy demanded.

The use of an alternator is a very desirable means of providing the work load, both because of its readily and precisely controllable loading, and also because of its usefulness in supplying the circuitry of the system with current. The alternator, in other words, in both a convenient source of electricity and an inductive element having output parameters which are easily monitored and which may be controlled by a single input variable, which in this case is a signal from microcomputer 40.

In the preferred embodiment, every two milliseconds a pulse is generated whose width is a function of the demanded load. Precise timing is insured by a 3.579 megahertz quartz crystal frequency reference. The signal, expressed as a percent duty cycle, is converted to an analog voltage signal level by a D/A converter 50. This voltage signal is the positive input to a field current regulator 52, which receives its negative input from a power output amplifier 54, and outputs signals on line 56 to control the field current of the alternator 26. The power output amplifier 54 provides a signal proportional to the output current of the alternator 26, receiving its positive input on line 58 carrying alternator output current, and its negative input on line 60 from a voltage regulator 62, which tightly regulates the output voltage of the alternator to a value received from a precision voltage reference 64.

The field current regulator 52 outputs current until the power output of amplifier 54 slightly exceeds the input control signal from D/A converter 50, thereby creating an error signal which shuts off the field current regulator 52 until the alternator power output drops below the input signal value from D/A converter 50. When that happens the field current regulator 52 automatically turns on again, delivering current to the alternator field. This turning on and off of regulator 52 maintains the alternator output at the demanded level. Increasing current in the alternator field tends to increase the strength of the magnetic field, thereby increasing resistance of the alternator to the operator's effort; and decreasing current in the alternator field tends to decrease the strength of the magnetic field, thereby decreasing resistance of the alternator to the operator's effort. In other words, if the alternator output is below the demand level, a field current increase is caused, which is accompanied by greater operator effort; and if the alternator output is above the demand level, a field current decrease is caused, which is accompanied by reduced operator effort.

As explained in Dimick U.S. Pat. No. 3,767,195, the ability to vary exercise levels during a given exercise program is considered highly useful both for physiological and for psychological reasons. It is also necessary to provide different effort levels available for operator selection, based either on the fitness level of the operator, or on the operator's choice of exercise difficulty. This has led to the development of a dual arrangement for providing different exercise difficulty levels. Table I illustrates an exemplary schedule of Body Kilocalories/Hour at various levels of operator-selected difficulty and automatically-varied difficulty.

TABLE I

| | | Body Kilocalories/Hour | | | | | | |
|---|---|---|---|---|---|---|---|---|
| | | Hill # | | | | | | |
| | | 1 | 2 | 3 | 4 | 5 | 6 | 7 |
| Level | 1 | 213 | 234 | 255 | 276 | 298 | 319 | 340 |
| | 2 | 213 | 255 | 298 | 340 | 383 | 425 | 468 |
| | 3 | 213 | 276 | 340 | 404 | 468 | 531 | 595 |
| | 4 | 213 | 298 | 383 | 468 | 553 | 638 | 723 |
| | 5 | 213 | 319 | 425 | 531 | 638 | 744 | 850 |
| | 6 | 255 | 383 | 510 | 638 | 765 | 893 | 1020 |
| | 7 | 298 | 446 | 595 | 744 | 893 | 1041 | 1190 |
| | 8 | 340 | 510 | 680 | 850 | 1020 | 1190 | 1360 |
| | 9 | 383 | 574 | 765 | 956 | 1148 | 1339 | 1530 |
| | 10 | 425 | 638 | 850 | 1063 | 1275 | 1488 | 1700 |

The horizontal lines in Table I, which are designated Levels 1 to 10, represent different levels of operator-selected difficulty. It is assumed the operator in the beginning will opt for a lower effort level, and will, in subsequent exercise programs, gradually increase the effort level to accompany fitness improvements.

The vertical columns are of primary interest in the present invention. They are designated Hills No. 1 to 7, which represent varying levels of difficulty that are caused to occur automatically during a single exercise program. Hill #1 requires the least effort, and Hill #7 requires the greatest effort. The reference to "hills" is based on the fact that the levels of effort which vary automatically during a single exercise program will simulate for the operator an undulating terrain having hills of different steepness.

The particular values in Table I are the result of certain decisions based on accumulated information concerning feasible levels of effort. The highest and lowest levels are selected to accommodate a wide range of operator fitness. Intervals between levels are preferably equal. The particular numerical values in Table I result from a conversion of kilipondmeter/second values initially selected, from which the relations between "hills" and the relations between "levels" were derived.

The relation between the energy output demanded from the alternator, and the assumed energy input provided by the operator must take into account both the efficiency factor of the alternator, and more importantly the energy output efficiency of the operator, which is assumed to be 20%. In other words, it is generally assumed that the operator expends five units of energy for every unit which is converted to useful energy output. Given these relationships, the alternator is calibrated to provide the desired output for various demand levels established by the microcomputer.

As the figures for levels 1 through 5 of the Hill No. 1 column show, there is a minimum feasible effort level, which results from the fact that the circuitry of the system has certain minimum energy requirements.

Figure 4:
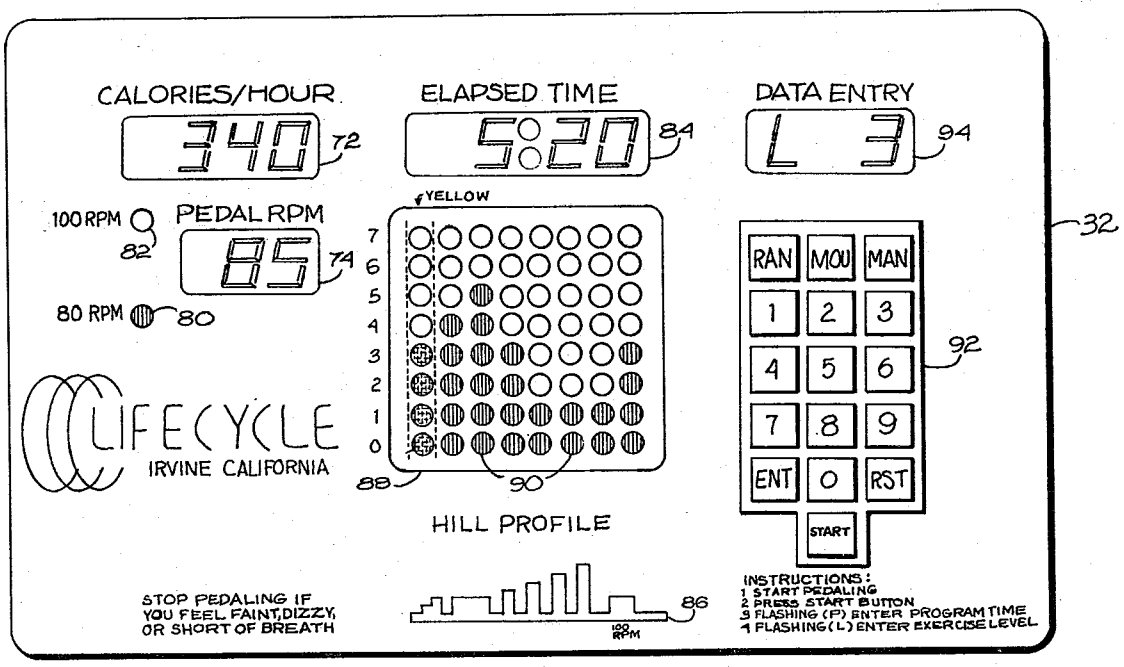
FIG. 4 is a front elevation of the display panel mounted on the exerciser.

Before reaching the random "hill" selection feature which is the gist of the present invention, it will be useful to describe briefly the displays shown in FIG. 4 on display panel 32. the calories/hour figure is displayed in a window 72; and the pedal RPM is displayed in a window 74. The panel RPM is calculated by the microcomputer from a signal supplied by an optical sensor 76 (see FIG. 2), which generates and sends a pulse via line 78 with each revolution of the sprocket 20. The two signal lights 80 and 82 flash at varying speeds to assist the operator in adjusting his pedal speed. Light 80 is used to maintain the normal speed, which is 80 RPM; light 82 is used to maintain a speed of 100 RPM during certain periods. Window 84 of the display panel shows the elapsed time since the start of the exercise program. The "bar graph" outline 86 at the bottom of the display represents the shape of a standard exercise program, available in either 6-minute or 12-minute lengths, which generally advances step by step from the lowest "hill" (#1) to the highest "hill" (#7). At the end it provides a kinesthetic stimulation period consisting of faster pedaling on a relatively easy "hill".

The display area 88 is a significant motivator for the operator, because it shows the present and upcoming levels of effort ("hills"). In the illustrated embodiment, eight columns of lights 90 (an 8×8 matrix of discrete red and yellow LEDs) display eight time increments, a convenient duration of each increment being 5 seconds. The column on the left, which shows yellow lights, indicates by its height the hill number presently being encountered. Proceding from the left, the height of each subsequent column indicates which hill number will be encountered in succeeding five-second intervals.

Figure 5:
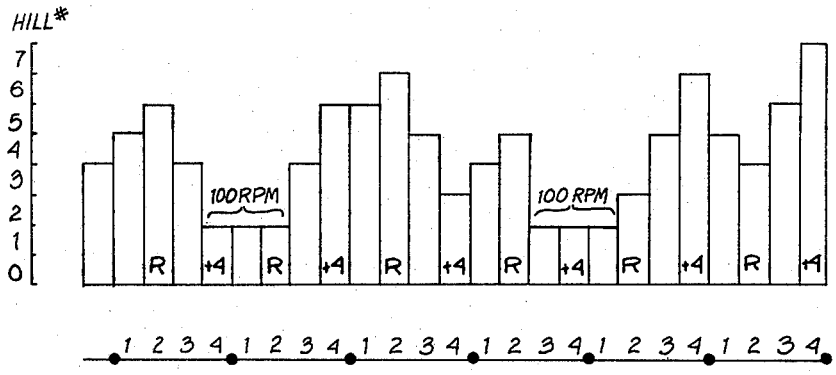
FIG. 5 is an example of a possible randomly-selected series of work load levels, utilizing the preferred method of combining random work load levels with other automatically selected work load levels.

In FIG. 4, the lights shown as turned on correspond to the first eight bars of the profile shown in FIG. 5. They indicate that the current five-second interval is at the effort level of Hill #3, to be followed in sequence by five seconds at level #4, five seconds at level #5, five seconds at level #3, fifteen seconds (three columns) at level #1, and five seconds at level #3.

Lights are, of course, available to show all levels of effort represented by the seven hill numbers. The lights do not represent different basic exercise levels (from 1 to 10).

A data entry keyboard 92, and a data entry window 94, are involved in the operator's selection of the desired exercise mode. When the operator turns on the exerciser by pedaling the exerciser and then pressing the start button, a flashing "P" appears on the left of the data entry display 94. The operator is then expected to select and enter the desired exercise program. The listed key sequences call forth the following program choices:

| Program | Keys |
|---|---|
| One minute program | 1, ENT |
| Two minute program | 2, ENT |
| Three minute program | 3, ENT |
| Four minute program | 4, ENT |
| Five minute program | 5, ENT |
| Six minute program | 6, ENT |
| Twelve minute program | ENT or 1, 2 ENT |
| Manual Program | MAN |
| Random Program | RAN |

The next step is an automatic appearance of the letter "L" in the data entry window, inviting the operator to enter the desired level of difficulty (1–10) by pressing the appropriate numerical key (or keys in the case of level 10).

The one minute through twelve minute programs are all based on the profile shown at 86 in the figure, and are generated by the microcomputer according to a table stored in the "read only" memory. The six minute program completes the steps of the profile in half the time consumed for the same series of steps in the twelve minute program (with each step lasting ten seconds in the twelve minute program, instead of five seconds). The one minute through five minute programs are attenuated versions of the six minute program, dropping off the final portion of the program. The random and manual programs are open-ended and may be continued indefinitely. The manual program stays at the effort level of Hill #7.

The "MOU" button is pressed by the operator when he wants the computer to calculate, and display in window 94, the MOU figure determined from an equation involving the operator's age, heart rate, and weight, all of which the operator enters by pressing the numerical keys. The "RST" button is used to select "rest" and "reset" options.

As previously stated, the focus of the present invention is a novel solution to the problem of operator motivation, i.e., avoiding boredom and a consequent failure to continue the fitness quest.

It appears that the solution of that problem is the presentation of a "random" exercise program, or, more properly, an exercise program which includes random portions not readily predictable by the operator. This "randomness" can be simulated by a pseudo-random programming of the microcomputer, which will provide a sequence which is extremely difficult to predict, but it is considered preferable to create intermittent random steps by a "throwing of the dice" technique, which will be explained below.

Along with the concept of randomly-selected hill numbers, it is considered highly important to provide a sequencing which will "balance" reasonably the "high hills" and "low hills", in order that the expected average level of effort desired by the operator will be approximated. Another problem with a completely random selection is that the terrain may not vary sufficiently, and therefore appears uninteresting on the display 88. The goal of "controlled randomness" may be accomplished by interposing between one randomly-selected hill number and the next randomly-selected hill number, a hill number which is "opposite" in difficulty level from the previous randomly-selected hill number. In other words, a high hill number will be followed by a correspondingly low hill number, and vice versa.

However, a further problem has been encountered, because an abrupt change between high and low hill numbers has a tendency to detract from the desired simulation of a gradually undulating terrain. In order to provide a smooth transition between below average and above average hill numbers, it appears desirable to provide intervening time increments whose hill values are determined by averaging the value of the preceding hill with that of the succeeding hill.

In the presently preferred embodiment of the present invention, the random program is generated by a set of procedures in which four five-second levels of "hill" effort are produced. The procedures fall into two parts, in the first of which a random hill level is generated, and in the second of which the preceding random hill level is offset by one-half the range of levels of effort. In each part the computed hill is preceded by a hill which is an average of the preceding and following hills. Thus four hills are generated for each random hill, in such a way as to make transitions from one level to another gradual, and to assure that transitions do take place.

The random hill may be generated by summing the contents of all registers in the computer modulo 256, then by separating the nine bits of the result into two four-bit and one one-bit parts, summing these and taking the three lowest-order bits as the result. This result is transformed into a hill level of effort by applying the further rule that if a zero results, which does not correspond to a hill level of effort, both the random hill and the preceding average hill shall be assigned the lowest level of hill effort, which has a value of one. It is a convenient, but coincidental advantage that seven hills are available, corresponding to the available numbers in a three-bit binary value.

The result of the sum of all registers tends to be random, or at least irregularly variable, because the registers contain synchronously time-varying data, asynchronously time-varying date, results of previous random steps, effects of operator inputs, and non-initialized data which may be assumed to be random, although non-variant during an exercise program.

Figure 3A:
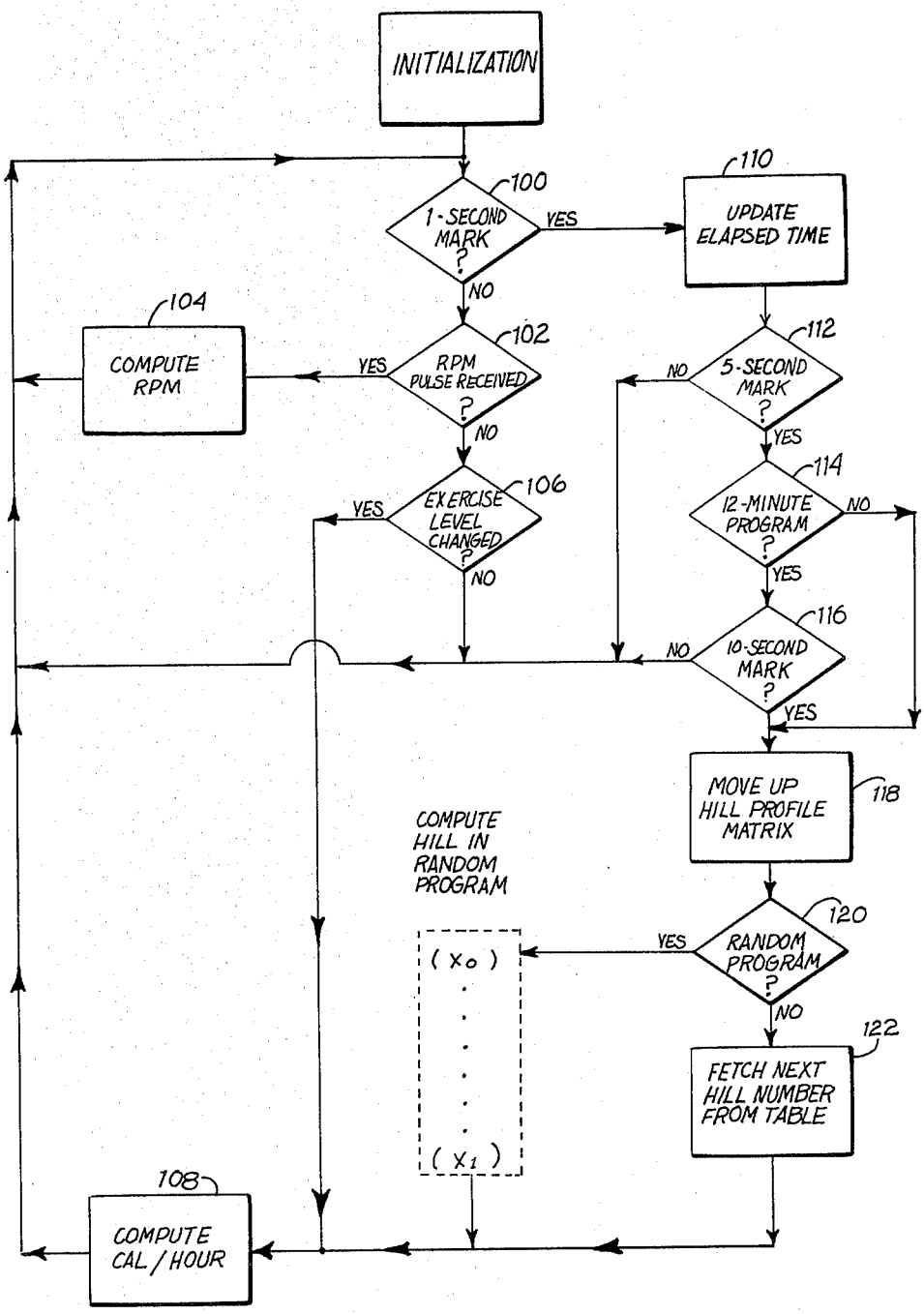
FIGS. 3A and 3B are flow, or logic, diagrams which summarize the control of the variable load accomplished by the microprocessor.
Figure 3B:
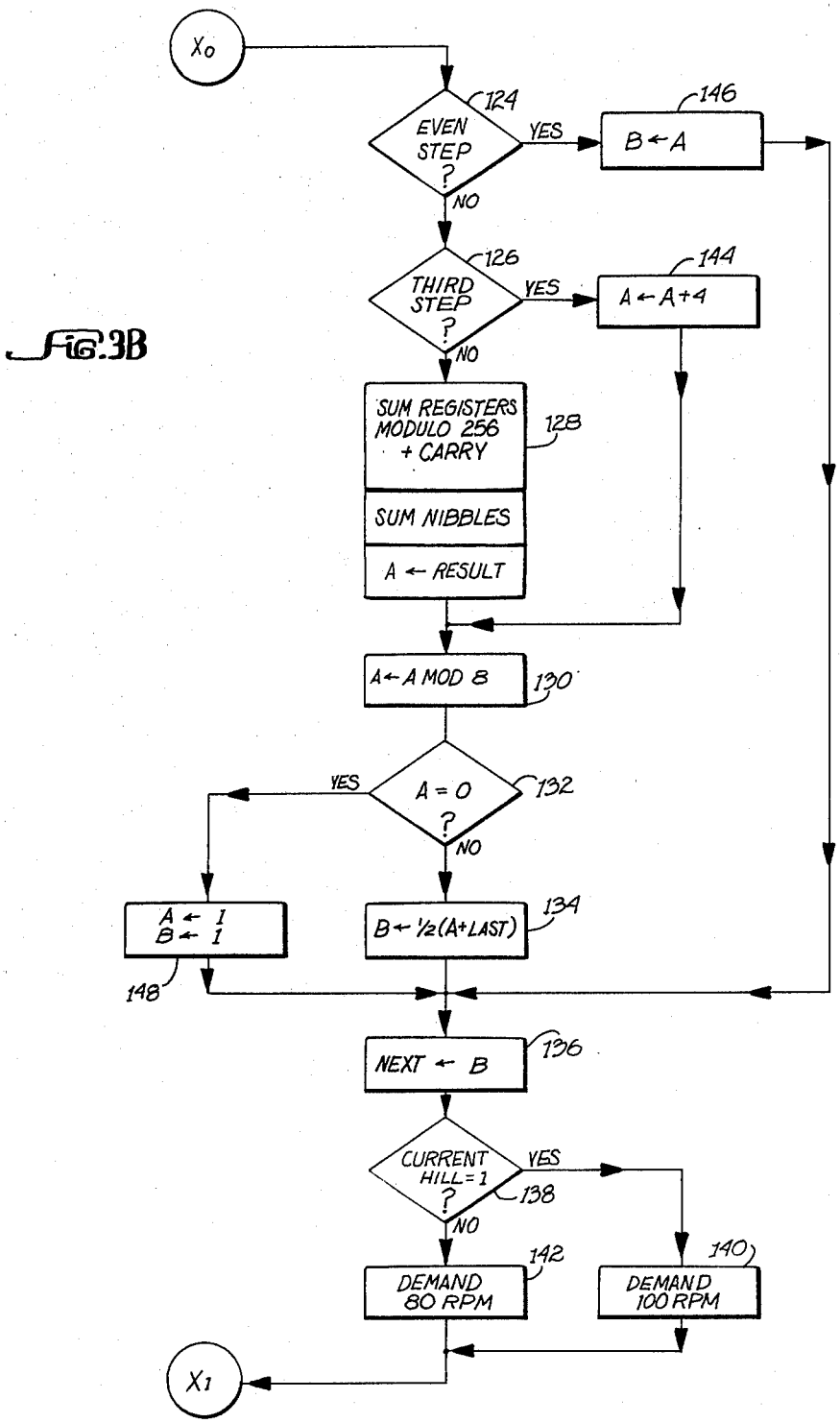

FIGS. 3A and 3B show the flow charts which demonstrate the control sequence used by the microcomputer in determining the width of the load control pulses output to the alternator circuit on line 48. In the flow diagrams, the diamond-shaped blocks are used to denote decisions, or branches; and the rectangular blocks are used to denote processes.

In FIG. 3A, after initialization, which includes a suitable warm-up procedure, decision block 100 determines whether one second has elapsed in the timer routines. If not, decision block 102 determines whether an RPM pulse has been received from the optical sensor 76. If an RPM pulse has been received, block 104 computes the RPM for display in window 74; and the path returns to the decision block 100. If the answer at decision block 102 is negative, the path leads to decision block 106, where it is determined whether the exercise level has changed. If the answer is "no", the path returns to the top of the loop at block 100. If the answer at block 106 is "yes", the path leads to process block 108, which causes the calories/hour to be computed for display in window 72; and the path returns to the top of the loop at block 100.

If the decision at block 100 is "yes", the path leads to process block 110, which causes the elapsed time to be updated and displayed in window 84. The path then leads to decision block 112, which determines whether the five-second mark has been reached. If the answer is "no", the path returns to the top of the loop at block 100. If the answer is "yes", the path leads to decision block 114, which determines whether the twelve-minute program is in effect. If the answer is "yes", decision block 116 determines whether the ten-second mark has been reached. If the answer at block 116 is "no", the path leads back to the top of the loop at block 100.

If the decision at block 114 is "no", or if the decision at block 116 is "yes", the path leads to process block 118, which causes the "hill profile" to advance, i.e., it moves up to the next five-second segment (or ten-second segment in a twelve-minute program). The path then goes to decision block 120, which determines whether the random program is in effect. If it is not in effect, process block 122 causes the next hill number to be fetched from the table in the memory, and the path returns through process block 108 to the top of the loop at block 100. If the random program is in effect, the path leads at $X_0$ into the flow chart shown in FIG. 3B, which deals with computation of the hills in the random program.

In the random program generation flow chart, shown in FIG. 3B, the first decision block 124 determines whether the step is "even" or "odd". There are four steps in each recurring sequence. In the embodiment described, during the first step a value is randomly-determined, and during the third step a value is determined by shifting the value from the previous random value by an amount equal to half of the range. These values are entered into the hill profile during the second and fourth steps, respectively, while the hills entered during the first and third steps are each determined by averaging the two hills between which they occur, i.e., the first hill is the average of the preceding hill and the randomly determined second hill, and the third hill is the average of the preceding second, or random, hill and the following fourth, or shifted, hill. Because of the desire to use intervening averaging hills, each calculation made during a given step must be stored and "loaded" into the program register one step later.

If the answer at decision block 124 is negative, decision block 126 next determines whether the step is the third step. If this answer is also negative, the first step is carried out by following the path to process block 128, which causes calculation of the random value.

In the presently preferred version of the invention, process block 128 involves a register-summing and remainder-extracting technique, which represents an arbitrary approach, but one which is both efficient and convenient. The computer registers are summed, and the sum modulo 256 plus carry is extracted. These values are separated into "nibbles" comprising two 4-bit and one 1-bit parts, and then summed. The three lowest order bits are taken as the result, thus providing eight possible randomly-selected values. These values are conveniently tied to the hill numbers by equating computer calculated values one through seven to Hills #1 through #7, respectively, and assigning to the computer value "zero" the energy level significance of two successive time segments of Hill #1, which has the effect of permitting a longer "rest" period. The two successive time segments of Hill #1 are allocated to the random hill being calculated and to the preceding average hill.

Process block 128 sets the value of register "A" as the result of the summing and nibbling calculation just described; and then the path leads to process block 130, which sets the value of register "A" as "A mod 8", limiting it to the remainder represented by the last three bits. Decision block 132 then determines whether "A" equals zero. If "A" is any value other than zero, the path leads to process block 134, which calculates the value in register "B" as the average of the preceding and following hills, by taking one-half of the sum of the new value of "A" plus the value of the last hill added to the program. The randomly-determined value remains in register "A".

The path then leads to process block 136, which sets the value of the next hill added to the program. Process block 136 sets the value of the next hill equal to the value in register "B", and "loads" or adds, that value into the "hill" profile which is stored in the display registers (see window 88 in FIG. 4). The new hill number is added as the last segment at the right of the eight time segments displayed in the window. With time segments equal to five seconds each, the latest entered value represents the difficulty level forty seconds later.

The flow chart from process block 136 goes to a decision block 138 which leads either to a process block 140, which demands a speed of 100 RPM if the current hill is Hill #1, or to a process block 142, which demands a lower speed of 80 RPM if the current hill number is higher than one. The path then returns to the logic path of FIG. 3A at $X_1$.

If the decision at block 126 is positive, indicating that the step being calculated is the third step, the path leads to process block 144, which sets the value in register "A" as equal to the previous value plus four. Thus, the value determined the third step (which becomes the fourth hill) is established by adding to the previous randomly-determined value one-half of the available value range of eight. In this way, it is insured that the successive random values will have an interposed, shifted value which is significantly different from the random value it follows and which, therefore, provides a load-averaging, as well as a load-varying, tendency. From process block 144, the path bypasses process block 128, and goes directly to process block 130, which sets register "A" at "A mod 8"; and the path then proceeds as previously described.

If the decision at block 124 is positive, i.e., that the step being calculated is even (the second or fourth step), then the path goes to decision block 146, which sets register "B" equal to the value in register "A", which has been previously calculated. The path then bypasses everything before process block 136, which sets the next hill as having the value in register "B", and causes it to be added as the latest value in the hill profile and display register.

The purpose of process block 148, which is reached if decision block 132 determines that the value in register "A" is zero, is to set both registers "A" and "B" at Hill #1, thereby providing two successive time increments at that low level of energy expenditure.

FIG. 5 has been included to make the description clearer by showing an example of a possible random program generation. In the "bar graph" shown, it is assumed that the column at the extreme left represents the last value in the preceding four-hill sequence, and that it was at the level of Hill #3. The next column shows the first hill in a sequence as a Hill #4, which is the average of the preceding hill value (Hill #3) and the following hill value (Hill #5). The next hill (second in the four-hill sequence) has a value (Hill #5) which was previously randomly determined. The next hill (third in the four-hill sequence) is the average value (Hill #3) of the preceding and following hills. The next hill (fourth in the four-hill sequence) has a value (Hill #1) which was previously determined as the modulo 8 sum of four (half the range of eight) plus the random hill value (Hill #5).

The next sequence of four hills has a second hill random value of Hill #1, a first hill averaged value of Hill #1 [1+1/2], a fourth hill shifted value of Hill #5 (1+4) and a third hill averaged value of Hill #3 [1+5/2]. As shown in the next averaged hill (the first hill of the third sequence), the averaged value is automatically reduced to the next lower integer.

The rest of the hill values are similarly determined. The hill profile is advanced every five seconds. After the initial warm up, hills come in groups of four. Number 2 is selected at random; number 1 is an average of number 2 and the preceding hill, in order to make the transitions less radical. Number 4 is chosen to be low if 2 was high, or vice versa; number 3 is an average of 2 and 4. The result is a fairly gently undulating series of hills, hitting the highs and the lows regularly but unpredictably.

This combination of random hill selection with suitable intermediate hills having a desired relation to the random hill has a strong advantage in motivating the operator. This advantage is attained, at least in part, because of the display panel, which visually indicates to the operator the profile of the "hills" which will occur during the time period covered by the display.

The following claims are intended not only to cover the specific embodiments disclosed, but also to cover the inventive concepts explained herein with the maximum breadth and comprehensiveness permitted by the prior art.

I claim:

1. In an exerciser apparatus, which provides variable loads to vary the energy expenditure demanded from the operator during an exercise program, the combination comprising:

means for generating a random number which is not predictable by the operator;

means for converting said random number into a corresponding value representing an energy expenditure level; and means for developing a load resisting the operator's energy which corresponds to said energy expenditure level.

2. An exercise control method, which provides variable loads to vary the energy expenditure demanded from the operator during an exercise program, comprising:

generating a random number which is not predictable by the operator;

converting said random number into a corresponding value representing an energy expenditure level; and developing a load resisting the operator's energy which corresponds to said energy expenditure level.

3. In an exerciser apparatus which provides the operator with variable loads to vary the demanded energy expenditure level during an exercise program, and which has a plurality of predetermined values available for selection, the combination comprising:

means for converting each such value into a corresponding energy expenditure level;

random-value-determining means for automatically selecting from time to time random values of energy expenditure which are not predictable by the operator;

other-value-determining means for automatically selecting, and interposing between successive random values, other values of energy expenditure which have predetermined relationships to the random values; and means for developing loads resisting operator energy which are determined by the automatically-selected energy expenditure values.

4. The exerciser apparatus combination of claim 3 wherein the other-value-determining means interposes shifted values between successive random values which are sufficiently spaced from the random values to provide an overall load-averaging tendency.

5. The exerciser apparatus combination of claim 4 wherein the other-value-determining means shifts each interposed value by approximately one-half of the available range of values.

6. The exerciser apparatus combination of either claim 4 or 5 wherein the other-value-determining means includes means for automatically selecting, and interposing between each random value and each adjacent shifted value, an averaged value derived by averaging the value of the nearest random and shifted values.

7. The exerciser apparatus combination of claim 6 wherein the exerciser apparatus includes a computer having memory registers, and the random-value-determining means comprises means for deriving the randomly-selected values from information stored in the computer registers.

8. The exerciser apparatus combination of claim 6 which also comprises:

means for displaying visually to the operator the present and future energy expenditure levels over a predetermined number of time segments.

9. The exerciser apparatus combination of any one of claims 1, 3, 4 or 5 wherein the exerciser apparatus includes a computer having memory registers, and the random-value-determining means comprises means for deriving the randomly-selected values from information stored in the computer registers.

10. The exerciser apparatus combination of any one of claims 1, 3, 4 or 5 which also comprises:

means for displaying visually to the operator the present and future energy expenditure levels over a predetermined number of time segments.

11. An exerciser control method, which provides the operator with variable loads to vary the demanded energy expenditure level during an exercise program, and which has a plurality of predetermined values available for selection, comprising the steps of:

converting each such value into a corresponding energy expenditure level;

automatically selecting from time to time random values of energy expenditure which are not predictable by the operator;

automatically selecting, and interposing between successive random values, other values of energy expenditure which have predetermined relationships to the random values; and developing loads resisting operator energy which are determined by the automatically-selected energy expenditure values.

12. The exerciser control method of claim 11 wherein shifted values are interposed between successive random values which are sufficiently spaced from the random values to provide an overall load-averaging tendency.

13. The exerciser control method of claim 12 wherein each interposed shifted value differs from the preceding random value by approximately one-half of the available range of values.

14. The exerciser control method of either claim 12 or 13 wherein a step is interposed between each random value step and each adjacent shifted value step which interposed step has an averaged value derived by averaging the value of the nearest random and shifted values.

15. The exerciser control method of any one of claims 2, 11, 12 or 13 including the step of deriving the randomly-selected value from information stored in computer registers.

16. The exerciser control method of any one of claims 2, 11, 12 or 13 which also includes the step of displaying visually to the operator the present and future energy expenditure levels over a predetermined number of time segments.

17. In an exerciser apparatus, which provides variable loads to vary the energy expenditure demanded from the operator during an exercise program, the combination comprising:

means for providing a series of varied apparatus control values, the sequence of which is not readily predictable by the operator;

means for converting each such control value into a certain energy demand level; and load-varying means for developing a series of operator energy expenditure levels, each of which corresponds to the concurrent energy demand level.

18. The exerciser apparatus combination of claim 17 wherein the load-varying means causes variations in operator energy expenditure levels primarily by varying the force exerted by the operator at a substantially constant speed.

19. An exercise control method, which provides variable loads to vary the energy expenditure demanded from the operator during an exercise program, comprising:

providing a series of varied apparatus control values, the sequence of which is not readily predictable by the operator;

converting each such control value into a certain energy demand level; and developing a series of operator energy expenditure levels, each of which corresponds to the concurrent energy demand level.

20. The exercise control method of claim 19 wherein variations in operator energy expenditure levels are caused primarily by varying the force exerted by the operator at a substantially constant speed.

* * * * *